United States Patent [19]

Belvederi

[11] Patent Number: 4,865,055

[45] Date of Patent: Sep. 12, 1989

[54] VENTILATED CIGARETTE OF UNIFORM FLAVOR

[75] Inventor: Bruno Belvederi, S. Martino di Monte S. Pietro, Italy

[73] Assignee: G. D. Societa' Per Azioni, Bologna, Italy

[21] Appl. No.: 929,633

[22] Filed: Nov. 12, 1986

[30] Foreign Application Priority Data

Nov. 25, 1985 [IT] Italy ..... 3622 A/85

[51] Int. Cl.[4] ..... A24D 3/04; A24D 3/10

[52] U.S. Cl. ..... 131/331; 131/336; 131/345

[58] Field of Search ..... 131/336, 331, 345

[56] References Cited

U.S. PATENT DOCUMENTS

| | | | |
|---|---|---|---|
| 2,841,153 | 7/1958 | Pelletier | 131/336 |
| 3,043,314 | 7/1962 | Bartolomeo | 131/336 |
| 3,608,561 | 9/1971 | Dock | 131/335 |
| 4,094,324 | 6/1978 | Bolsinger et al. | 131/336 |

*Primary Examiner*—V. Millin

*Attorney, Agent, or Firm*—Marshall, O'Toole, Gerstein, Murray & Bicknell

[57] ABSTRACT

A ventilated cigarette having a filter consisting of filtering material wrapped in an outer cover strip having a number of radial ventilating holes; at least the portion of the aforementioned filtering material communicating externally through the ventilating holes and through the open end of the filter consisting of material which becomes increasingly permeable by air as its steam content and/or temperature increases.

3 Claims, 1 Drawing Sheet

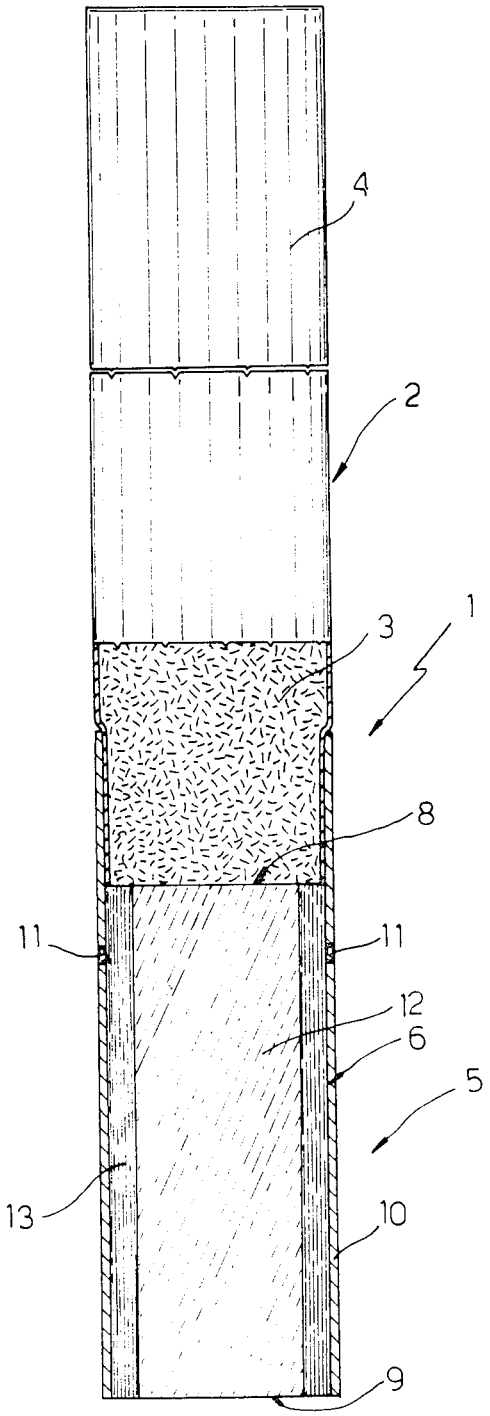
4
2
1
3
8
11
11
12
6
5
13
10
9

VENTILATED CIGARETTE OF UNIFORM FLAVOR

BACKGROUND OF THE INVENTION

The present invention relates to a ventilated cigarette of uniform flavour.

In particular, the present invention relates to a cigarette comprising a filter consisting of an inner core of filtering material and an outer cover strip connecting the said filter to the remainder of the cigarette, and in which a number of radial holes are formed through the said strip for enabling external communication of the said inner core.

When a known ventilated cigarette of the aforementioned type is drawn on by the smoker, a stream of air is forced through both the lighted end of the cigarette and the said ventilating holes. Inside the filter, the relatively cool, clean air flowing through the ventilating holes mixes with the relatively hot air and combined combustion products from the lighted end of the cigarette, so as to dilute and reduce the temperature of the smoke and so reduce the amount of nicotine and tar contained therein.

Tests performed on known ventilated cigarettes of the aforementioned type have shown that the effectiveness of the cool air flowing through the said ventilating holes diminishes gradually as the cigarette burns down. This is mainly due to the fact that, throughout combustion, the unconsumed portion of the cigarette substantially acts as a filter for the combustion fumes, and retains part of the toxic substances contained therein. Consequently, as the cigarette gradually burns down to the filter, the "flavour" of the cigarette gradually gets "stronger" as the amount of nicotine and tar in the unconsumed portion increases.

This change in flavour as the cigarette burns down, and which is accompanied by gradually diminishing effectiveness of the cool air stream through the ventilating holes, is heightened even further by the fact that the temperature of the combustion products reaching the filter increases as combustion continues, and is increasingly unaffected by the said cool air stream.

SUMMARY OF THE INVENTION

The aim of the present invention is to provide a ventilated cigarette the flavour of which, influenced by the amount of nicotine and tar contained in the smoke, remains substantially unchanged during combustion.

With this aim in view, according to the present invention, there is provided a ventilated cigarette of uniform flavour, which cigarette presents a substantially cylindrical filter having an open end and comprising a core consisting of filtering material, and a lateral outer covering comprising a cover strip having a number of radial ventilating holes; characterised by the fact that at least the portion of the said filtering material communicating externally through the said ventilating holes and through the said open end consists of material which becomes increasingly permeable by air as its steam content and/or temperature increases.

As progressive combustion causes an increase in both the temperature of the combustion products reaching the filter and in the amount of steam formed during combustion and retained by the filter, the ventilated cigarette according to the present invention and as defined above enables gradually increasing quantities of air to flow through the ventilating holes, so as to maintain the inhaled amount of nicotine and tar and, consequently also, the flavour of the cigarette substantially constant throughout combustion.

According to a preferred embodiment of the present invention, the said portion of filtering material comprises drawn-only natural fibres, preferably textile; the term "drawn-only" being taken to mean drawn natural fibres not subjected to relatively hot steam decatizing for setting the drawn configuration of the fibres.

BRIEF DESCRIPTION OF THE DRAWING

The invention will now be described with reference to the attached drawing, which shows an axial section of a cigarette according to the teachings of the present invention.

DETAILED DESCRIPTION OF THE INVENTION

Number 1 in the attached drawing indicates a ventilated cigarette comprising a cylindrical combustible portion 2 consisting of shredded tobacco 3 wrapped in an outer paper 4, and a cylindrical filter 5.

Filter 5 is arranged coaxial with the said combustible portion 2 and comprises an inner core 6, one end 8 of which faces one end of combustibe portion 2, and the other end 9 of which communicates externally. Core 6 is laterally covered by a strip 10, one end of which coincides with end 9, and the other end of which projects beyond end 8 so as to cover an end portion of outer paper 4 and so connect together combustible portion 2 and filter 5.

Inner core 6 communicates directly with the outside through end 9 as well as through a ring of ventilating holes 11 formed in strip 10. In the embodiment shown, inner core 6 comprises a centre core 12, consisting of ordinary filtering material, and a peripheral layer 13 arranged between strip 10 and core 12 and communicating externally through both end 9 and ventilating holes 11.

Depending on the type of tobacco 3 employed, peripheral layer 13 may vary in thickness to the extent that centre core 12 is substantially reduced to zero, and consists, either entirely or partially, of a special filtering material which becomes increasingly permeable by air as its steam content and/or temperature increases.

The said special filtering material may comprise, among other things, drawn-only, i.e. non-decatized, natural fibres, in particular, textile fibres such as cotton. A known property of such fibres is that they gradually shrink back to their normal entwined configuration in the presence of increasing quantities of steam and/or rising temperature.

Gradual entwining of the said fibres is accompanied by increased permeability of layer 13 and, consequently also, a reduction in the resistance of layer 13 to the air stream flowing through ventilting holes 11 as combustible portion 2 gradually burns down towards filter 5. As a result, an increasingly large part of the gas inhaled by the smoker through open end 9 of filter 5 consists of the air flowing through holes 11; which increasng percentage of cool air in the said gas tends to maintain substantially constant both the amount of nicotine and tar present in the said gas, and the "flavour" of cigarette 1 throughout combustion of the said combustible portion 2.

I claim:

1. A ventilated cigarette of uniform flavour, comprising a cylindrical end-filter (5) having an open end (9) and an inner filtering core (6) made of filtering material and an outer cover strip (10); the cover strip (10) having a number of ventilating throughholes (11); the core (6) having a portion (13) directly communicating with the atmosphere external of the cigarette through the ventilating holes (11) and through said open end (9); and the filtering material of the core portion (13) being a material which becomes increasingly permeable by air as its steam content and/or temperature increases as a result of contact with combustion products of said cigarette.

2. A cigarette as claimed in claim 1 wherein the filtering material of said core portion (13) comprises drawn-only natural fibres.

3. A ventilated cigarette as claimed in claim 2, characterised by the fact that the said natural fibres are textile.

* * * * *